US005800970A

United States Patent [19]

Tamura

[11] Patent Number: 5,800,970

[45] Date of Patent: Sep. 1, 1998

[54] FLAW-MENDING AGENT FOR PHOTOGRAPHS AND METHOD FOR MENDING FLAWS

[75] Inventor: Yutaka Tamura, Minami-ashigara, Japan

[73] Assignee: Fuji Photo Film Co., Ltd., Minami-ashigara, Japan

[21] Appl. No.: 843,337

[22] Filed: Apr. 15, 1997

[30] Foreign Application Priority Data

Apr. 17, 1996 [JP] Japan ..... 8-095476

[51] Int. Cl.[6] ..... G03C 11/06

[52] U.S. Cl. ..... 430/432; 430/359

[58] Field of Search ..... 430/359, 432

[56] References Cited

FOREIGN PATENT DOCUMENTS

A 41730 12/1972 Japan .

*Primary Examiner*—Hoa Van Le

*Attorney, Agent, or Firm*—Burns, Doane, Swecker & Mathis, LLP

[57] ABSTRACT

There is disclosed a flaw-mending agent for photographs which comprises a liquid having a refractive index in the range of 1.5 to 1.8, and a viscosity in the range of 0.1 cP to 100 cP. There is also disclosed a method for mending flaws using the flaw-mending agent. The flaw-mending agent is useful for mending flaws on silver halide photographic light-sensitive materials, easy to handle, and high in flaw-mending effect.

9 Claims, No Drawings

FLAW-MENDING AGENT FOR PHOTOGRAPHS AND METHOD FOR MENDING FLAWS

FIELD OF THE INVENTION

The present invention relates to flaw-mending agents for photographs and relates to methods for mending flaws on the silver halide photographic light-sensitive materials.

BACKGROUND OF THE INVENTION

Generally, after a silver halide light-sensitive film (hereinafter abbreviated to a photographic film, a photographic light-sensitive material, or a light-sensitive material) has been loaded in a camera and photographs have been taken, it is processed, for example, through development processing and printing on photographic printing paper. During the process, the photographic film comes in contact with various things and suffers flaws such as scratches. The flaws develop at the time of printing, on the images of the photographic printing paper, to cause a problem.

To solve this problem, a method described in JP-A ("JP-A" means unexamined published Japanese patent application) No. 41730/1972 is known. In the method, a cellulose acetate-series polymer is dissolved in a solvent, such as dichloromethane, and the solution is applied to the part having flaws in the photograph. Such a flaw-mending agent is accompanied by such problems that (1) the flaw-mending effect is satisfactory where the flaws are shallow, but is unsatisfactory where the flaws are deep, and (2) it is required to wait until the applied part is satisfactorily dried after the application, as well that the agent is not easy to use because it bubbles while drying.

SUMMARY OF THE INVENTION

An object of the present invention is to provide a flaw-mending agent for photographs that is easy to handle and high in flaw-mending effect.

Another object of the present invention is to provide a method for mending flaws on silver halide photographic light-sensitive materials that is easily carried out and is high in flaw-mending effect.

Other and further objects, features, and advantages of the invention will appear more fully from the following description.

DETAILED DESCRIPTION OF THE INVENTION

The present invention provides a flaw-mending agent for photographs, comprising a liquid having a refractive index in the range of 1.5 to 1.8, and a viscosity in the range of 0.1 cP to 100 cP.

The present invention has been obtained as a result of a full investigation of flaws that cannot be mended (erased) with conventional flaw-mending agents. That is, it has been made clear that deep flaws cannot be mended with conventional flaw-mending agents due to the following mechanism:

(1) In the case of a V-shaped deep flaw, the conventional flaw-mending agent cannot penetrate into its depth, allowing an air layer to remain.

(2) When the conventional flaw-mending agent is applied uniformly, flaws are difficult to see, but where air remains, the flaws cannot be mended satisfactorily.

Therefore to solve this, preferably the viscosity of the liquid flaw-mending agent is brought to in the range of from 0.1 cP to 100 cP, more preferably from 0.5 cP to 70 cP, and furthermore preferably from 10 cP to 40 cP. For this adjustment of the viscosity, a liquid compound having such a viscosity itself may be used singly, or the viscosity can be adjusted by mixing a liquid compound having a high viscosity with a liquid compound having a low viscosity. It is also preferable to add a surface-active agent to adjust the viscosity. As the surface-active agent, any of nonionic surface-active agents, cationic surface-active agents, anionic surface-active agents, ampholytic surface-active agents, or fluorine-containing surface-active agents can be used, with particular preference given to fluorine-containing surface-active agents. The amount of the surface-active agent to be added is dependent on the adjustment of viscosity, and it is about 0.01 to 30% by weight, and preferably 0.1 to 15% by weight.

Preferably the refractive index of the flaw-mending agent is in the range of from 1.50 to 1.80, more preferably from 1.54 to 1.78, and furthermore preferably from 1.60 to 1.75. This is because that makes a flaw difficult to see if air remains in the depth of the flaw. That is, because, as the material used for photographic supports, use is made of, for example, cellulose triacetates (TAC), polyethylene terephthalates (PET), or polyethylene naphthalates (PEN), and their average refractive indexes are, respectively, 1.48, 1.53, and 1.63, preferably the refractive index of the flaw-mending agent is made to be equal to or a little higher than these refractive indexes of the materials. This is because, although the refractive index of air is as low as 1, the effect of air, if it remains, can be canceled easily by setting the refractive index of the flaw-mending agent to be the same as or slightly higher than the refractive index of the support. As the liquid having such a refractive index, a liquid compound may be used singly, or a mixture of two or more liquid compounds having different refractive indexes may be used. It is also preferable to adjust the refractive index by adding a solid compound to these.

Further, preferably the contact angle between the flaw-mending agent and the photographic support, i.e. a polyester film or a cellulose acetate film, is in the range of from 1 degree to 30 degrees, more preferably from 3 degrees to 28 degrees, and furthermore preferably from 5 degrees to 26 degrees. If the contact angle is over this range, the flaw-mending agent cannot enter satisfactorily the inside of a V-shaped flaw, and the flaw-mending effect cannot be attained, on occasions. On the other hand, if the contact angle is below the range, when the flaw-mending agent is applied to a film, the flaw-mending agent may go unpreferably to the undersurface of the film. To attain that contact angle, a single liquid compound may be used, or a mixture of two or more liquid compounds having different refractive indexes may be prepared. Further, also preferably the contact angle is adjusted by adding, for example, the above-described surface-active agents.

Further, the boiling point of the flaw-mending agent of the present invention is preferably in the range of from 100° C. to 500° C., more preferably from 120° C. to 480° C., and further preferably from 150° C. to 450° C. This is because, in the use of the flaw-mending agent of the present invention, it is more preferable to use a low-volatile liquid flaw-mending agent as it is, than to use a high-volatile solvent containing solids that will be applied and dried. Using the former method, the waiting period required until it is dried becomes nil, and furthermore bubbles that might often occur during the drying process can be suppressed. Thus, if the boiling point is below the above range, bubbling easily occurs, which is unpreferable. On the other hand, if the boiling point is over the above range, there are not many organic solvents that can be used generally.

Therefore, when the low-volatile flaw-mending agent of the present invention is used, preferably after the application the excess agent is wiped away. Preferably the molecular weight of any of the components constituting the flaw-mending agent of the present invention is in the range of from 18 to 10,000, more preferably from 18 to 8,000, and furthermore preferably from 18 to 5,000. This is because, if any component having a molecular weight over this range is present, uneven wiping easily occurs, which is unpreferable. On the other hand, general solid/liquid compounds that have molecular weights below this range do not exist.

Specific examples of compounds having such refractive indexes and viscosities include the following compounds, but the present invention is not limited to them:

| No. | Flaw-mending agent composition | (abbreviation) | Refractive index | Viscosity (cP) | Contact angle With PET (Degrees) | With PEN (Degrees) | With TAC (Degrees) | Boiling point (°C.) |
|---|---|---|---|---|---|---|---|---|
| #1 | tricresol phosphate | (TCP) | 1.56 | 67 | 10 | 9 | 6 | 420 |
| #2 | 1-bromonaphthalene | (1BN) | 1.66 | 5.1 | 23 | 20 | 12 | 281 |
| #3 | diiodomethane | (DIM) | 1.71 | 2.6 | 32 | 31 | 17 | 181 |
| #4 | 1-chloronaphthalene | (1CN) | 1.63 | 2.9 | 25 | 22 | 12 | 260 |
| #5 | dimethyl phthalate | (PDM) | 1.52 | 17 | 15 | 14 | 9 | 282 |
| #6 | ethylene bromide | (DBE) | 1.54 | 1.7 | 20 | 19 | 11 | 131 |
| #7 | α-chloronaphthalene | (αCN) | 1.63 | 2.9 | 23 | 22 | 14 | 259 |
| #8 | p-chlorotoluene | (PCT) | 1.52 | 1.0 | 20 | 18 | 12 | 162 |
| #9 | bromobenzene | (BrB) | 1.56 | 1.1 | 17 | 17 | 10 | 156 |
| #10 | o-dibromobenzene | (ODB) | 1.61 | 1.5 | 22 | 21 | 14 | 223 |
| #11 | cresyl diphenyl phosphate | (CDP) | 1.56 | 21 | 14 | 12 | 10 | 245 |
| #12 | benzyl alcohol | (BA) | 1.54 | 7.8 | 12 | 11 | 7 | 205 |
| #13 | butyl benzyl phtalate | (BBP) | 1.54 | 18 | 14 | 11 | 10 | 370 |
| #14 | TCP + SA-1 (10 wt %) | | 1.54 | 68 | 6 | 4 | 3 | 425 |
| #15 | TCP + SA-1 (5 wt %) | | 1.55 | 67 | 7 | 6 | 4 | 422 |
| #16 | TCP + SA-2 (10 wt %) | | 1.55 | 83 | 4 | 6 | 3 | 428 |
| #17 | TCP + SA-3 (10 wt %) | | 1.54 | 61 | 5 | 5 | 3 | 427 |
| #18 | TCP + SA-4 (10 wt %) | | 1.55 | 67 | 9 | 8 | 5 | 429 |
| #19 | TCP + SA-5 (10 wt %) | | 1.53 | 61 | 9 | 8 | 5 | 430 |
| #20 | 1CN + SA-1 (10 wt %) | | 1.61 | 5.3 | 9 | 6 | 4 | 272 |
| #21 | 1CN + SA 2 (10 wt %) | | 1.62 | 6.2 | 7 | 5 | 3 | 275 |
| #22 | DIM + SA-1 (10 wt %) | | 1.70 | 6.7 | 12 | 10 | 8 | 191 |
| #23 | DIM + SA-2 (10 wt %) | | 1.70 | 6.2 | 13 | 10 | 8 | 192 |
| #24 | TCP:50 wt % + DIM:50 wt % | | 1.63 | 34 | 18 | 14 | 9 | 315 |
| #25 | PDM:50 wt % + DIM:50 wt % | | 1.61 | 11 | 19 | 17 | 11 | 235 |
| #26 | TCP:50 wt % + DIM:50 wt % + SA-1 (10 wt %) | | 1.59 | 12 | 5 | 2 | 3 | 246 |

In the above, SA-1 to SA-5 are the following compounds:

SA-1: fluoroalkyl polyoxyethylene ether (FT-250, trade name; manufactured by Neos Co.)

SA-2: fluoroalkyl polyoxyethylene ether (FT-251, trade name; manufactured by Neos Co.)

SA-3: diglycerintetrakis(fluoroalkyl) polyoxyethylene ether (DFX-18, trade name; manufactured by Neos Co.)

SA-4: sodium dodecylbenzenesulfonate

SA-5: polyethylene glycol-4000

Preferably, after the flaw-mending agent of the present invention is applied to a negative or positive light-sensitive material and printing is carried out with a printer, the flaw-mending agent is wiped away. The application may be carried out by any of brushing, dip coating, roller coating, and spraying, or by using a cloth impregnated with the flaw-mending agent. The region where the application will be made may be only the site where there is a flaw, or it may be all of the image area. The application is preferably made not on the emulsion side but on the backing side. If the application is made on the emulsion side, the flaw-mending agent possibly affects dyes or the like contained in the light-sensitive material, to damage the image. The thickness of the applied coat is preferably in the range of 0.01 μm to 100 μm. The application may be carried out before or during the loading of the negative carrier of the printer.

The wiping of the flaw-mending agent after the application and printing is preferably carried out with a lower alcohol. This is because such functions as slipping property and antistatic properties given to the backing layer must not be damaged when the wiping is carried out. Herein, "a lower alcohol" means monohydric or polyhydric alcohols having at most 5 carbon atoms, and preferably methanol, ethanol, and isopropanol can be mentioned. They may be used singly or as a mixture of two or more. It is also preferable to add a low-molecular compound, such as a surface-active agent. The wiping can be carried out using a cloth impregnated with such an alcohol.

The light-sensitive material whose flaws will be mended with the flaw-mending agent of the present invention may comprise a cellulose acetate-series support or a polyester-series support. In the case of polyester-series supports, the effect of the present invention is exhibited remarkably. This is because generally the refractive indexes of polyester-series supports are high, the difference between those refractive indexes and the refractive index of air remaining in a V-shaped flaw is large, to make the flaw conspicuous, and such a flaw can effectively be mended with the flaw-mending agent of the present invention. When, out of such polyester-series supports, a high-refractive-index support, such as polyethylene terephthalate (PET)-series supports and polyethylene naphthalate (PEN)-series supports, is used, the effect is more remarkably exhibited. Herein "PET-series supports" refers to those wherein the terephthalic acid content in all the dicarboxylic acid components, and the ethylene glycol content in all the diol components, are each over 50 mol %. Herein "PET-series supports" refers to those wherein the 2,6-naphthalenedicarboxylic acid content in all the dicarboxylic acid components, and the ethylene glycol content in all the diol components, are each over 50 mol %.

Further, the present invention is more effective when these supports are heat-treated at a temperature of at least 40° C., and at most the glass transition temperature (Tg). This is because, as a result of the heat treatment, the brittleness of the supports is increased, the occurred flaws are apt to form burrs, and air is apt to remain in gaps between them.

Further, the light-sensitive material to be printed may be photographic printing paper, or negative or positive light-sensitive material.

The measurement methods that were carried out in the present invention are described below.

(1) Refractive Index

Liquid samples: The measurement was carried out using an Abbe refractometer, and sodium D-line as a light source, at 25° C.

Film samples: The measurement was carried out using an Abbe refractometer, and sodium D-line as a light source, at 25° C. A polarizer was used to measure the refractive index in the longitudinal direction (nx), the refractive index in the width direction (ny), and the refractive index in the thickness direction (nz), to find the average refractive index (n), according to the following equation:

$$n=\{(nx+ny)/2+nz\}/2$$

(2) Viscosity

The viscosity of the sample was measured using an E-type viscometer (VISCONIC ED-type), manufactured by Tokyo Keiki KK, at 25° C.

(3) Contact Angle

A drop of a sample was dropped on an untreated film of polyester, cellulose acetate, or the like, using a microsyringe, and after 30 sec the contact angle was measured, at 25° C. and 60% RH, using a contact angle meter CA-DT A-type, manufactured by Kyowa Kaimen Kagaku KK.

(4) Molecular Weight

In the case of compounds having no repeating unit, the molecular weight was calculated from the structural formula. In the case of compounds having repeating units, the weight-average molecular weight (Mw) was found in terms of the molecular weight of a polystyrene, using gel permeation chromatography (GPC).

(5) Boiling Point

The boiling point was measured by finding the temperature at the start of boiling under 1 atmosphere, using a thermometer.

The flaw-mending agent of the present invention, for silver halide photographic light-sensitive materials, is easy to handle and is high in effectiveness of mending flaws.

Now, the present invention is described in more detail with reference to Examples, but the present invention is not limited to them.

EXAMPLE

Example 1

(1) Preparation of flaw-mending agents

Flaw-mending agents shown in Table 1 were prepared. The refractive indexes, the viscosities, and the boiling points were measured by the above-described methods. The results are shown in Table 1.

TABLE 1

| | Flaw-mendeing agent | | | | | | | Load | Capability to be wiped away flaw-mending agent | |
|---|---|---|---|---|---|---|---|---|---|---|
| Level | Composition[1] ("%" in composition ratio means wt % to the total amount) | Refractive index | Viscosity (cP) | Boiling point (°C.) | Support used in light-sensitive material | Contact angle (degree) | Bubbling | under which flaw began to appear (g) | Wiping Solvent | Surface appearance after wiping |
| This invention 1 | TCP + SA-1 (10%) | 1.54 | 68 | 425 | A-PEN | 4 | ○ | 15 | IPA | ○ |
| This invention 2 | TCP + SA-1 (10%) | 1.54 | 68 | 425 | PEN | 4 | ○ | 15 | IPA | ○ |
| This invention 3 | TCP + SA-1 (10%) | 1.54 | 68 | 425 | PET | 6 | ○ | 14 | IPA | ○ |
| This invention 4 | TCP + SA-1 (10%) | 1.54 | 68 | 425 | TAC | 3 | ○ | 14 | IPA | ○ |
| This invention 5 | TCP + SA-2 (10%) | 1.55 | 83 | 428 | A-PEN | 6 | ○ | 14 | IPA | ○ |
| This invention 6 | TCP + PEG8000[2] (10%) | 1.53 | 61 | 430 | A-PEN | 8 | ○ | 16 | IPA | ○~Δ |
| This invention 7 | TCP + PEG12000[3] (10%) | 1.52 | 63 | 436 | A-P)EN | 9 | ○ | 16 | IPA | Δ |
| This invention 8 | 1CN + SA-1 (10%) | 1.61 | 5.3 | | A-PEN | 9 | ○ | 18 | IPA | ○ |
| This invention 9 | 1BN | 1.66 | 5.3 | | A-PEN | 9 | ○ | 18 | IPA | ○ |
| This invention 10 | DIM + SA-1 (10%) | 1.70 | 6.7 | 191 | A-PEN | 7 | ○ | 20 | IPA | ○ |
| This invention 11 | DIM + SA-1 (1%) | 1.71 | 5.9 | 183 | A-PEN | 27 | ○ | 14 | IPA | ○ |
| This invention 12 | DIM | 1.71 | 2.6 | 181 | A-PEN | 31 | ○ | 10 | IPA | ○ |
| This invention 13 | DBE + DCM (50%) | 1.51 | 2.1 | 85 | A-PEN | 17 | Δ | 17 | IPA | ○ |
| This invention 14 | DBE + DCM (30%) | 1.51 | 2.3 | 112 | A-PEN | 19 | ○ | 14 | IPA | ○ |
| This invention 15 | TCP + SA-1 (10%) | 1.54 | 68 | 425 | A-PEN | 4 | ○ | 15 | hexanol | Δ |
| This invention 16 | TCP + SA-1 (10%) | 1.54 | 68 | 425 | A-PEN | 4 | ○ | 15 | ethanol | ○ |
| This invention 17 | TCP + SA-1 (10%) | 1.54 | 68 | 425 | A-PEN | 4 | ○ | 15 | methanol | ○ |
| This invention 18 | CDP | 1.56 | 21 | 245 | A-PEN | 12 | ○ | 17 | IPA | ○ |
| This invention 19 | CDP + SA-1 (10%) | 1.55 | 18 | 252 | A-PEN | 7 | ○ | 19 | ethanol | ○ |
| Comparative example 1 | DBP[4] (50%) + 1CN (50%) | 1.61 | 122 | 285 | A-PEN | 7 | ○ | 7 | IPA | ○ |
| Comparative example 2 | DCM[5] (95%) + TAC[5] (5%) | 1.46 | 3.2 | 41 | A-PEN | 14 | X | 5 | IPA | X |
| Comparative example 3 | not used | — | — | — | A-PEN | — | — | 1 | — | — |

TABLE 1-continued

| Level | Flaw-mendeing agent: Composition[1] ("%" in composition ratio means wt % to the total amount) | Refractive index | Viscosity (cP) | Boiling point (°C.) | Support used in light-sensitive material | Contact angle (degree) | Bubbling | Load under which flaw began to appear (g) | Capability to be wiped away flaw-mending agent: Wiping Solvent | Surface appearance after wiping |
|---|---|---|---|---|---|---|---|---|---|---|
| Comparative example 4 | not used | — | — | — | PEN | — | — | 5 | — | — |

[1]One having no foot note to be used means the abbreviation described in the description,
[2]PEG8000: polyethylene glycol (Mw = 8000),
[3]PEG12000: polyethylene glycol (Mw = 12000),
[4]DBP: dibutyl phthalate,
[5]DCM: dichloromethane,
[6]TAC: triacetyl cellulose (Mw = 53000)

(2) Evaluation of the flaw-mending agents

The samples used were a silver halide photographic light-sensitive material wherein a PET-1A support described in Example 1 of Hatsumei-kyokai Kokai-gihou (Kogi No. 94-6023) was used, a light-sensitive material wherein a PEN-1H support (annealed at 40° C. or above, but Tg or below; shown in Table 1 as "A-PEN") was used, and a light-sensitive material prepared in the same way as that for the PEN-1H support light-sensitive material, except that the PEN support used had not been annealed at 40° C. or above, but Tg or below (shown in Table 1 as "PEN"). Further, as a TAC light-sensitive material, a color negative film, Super G-400, trade name; manufactured by Fuji Photo Film Co., Ltd., was used.

After the entire frames of these light-sensitive materials were subjected to gray exposure and were subjected to development treatment in a usual manner, they were flawed using a diamond needle having a diameter of 50 μm, with the load changed continuously from 0 g to 20 g. Thereafter, the whole surface of each image area was coated with the flaw-mending agent, using a brush, and a print on photographic printing paper (Fuji Color Paper FA-7AGL, trade name; manufactured by Fuji Photo Film Co., Ltd.) was made using a printer (PP-1820V, manufactured by Fuji Photo Film Co., Ltd.). At that time the light-sensitive material was allowed to stand still for 5 min on the printer, and bubbling of the flaw-mending agent was visually evaluated. The results are shown in Table 1. "○" designates that there were no bubbles, "Δ" designates that there were no bubbles immediately after setting on the printer, but there were a few bubbles after 5 min (acceptable), and "X" designates that bubbles were generated immediately after setting, which is not acceptable.

The photographic printing papers were subjected to development treatment, the images of flaws printed in the prints were visually confirmed, and the load under which a flaw began to appear was found. The load of each case is shown in Table 1. With respect to the supports that were not treated (for example, not surface-treated and not coated with an undercoating), the contact angle between the support and the flaw-mending agent, used for each of the light-sensitive materials, was measured in the above-described manner. The results are shown in Table 1.

After the printing, the flaw-mending agents were wiped away with the wiping solvents shown in Table 1, and thereafter the appearance of the surface of each of the light-sensitive materials was visually evaluated (exfoliation of the backing layer, milk-whitening due to remaining wiping agent etc.). "○" designates that there was no problem; "Δ" designates that, although the haze was increased a little, the printing was not affected (acceptable); and "X" designates that the film back surface was damaged, which was not acceptable.

(3) Results

With respect to This Inventions 1–19, each had a good flaw-mending function, there was no bubbling, the capability to be wiped away was excellent, and the handling performance was good. The details are as follows:

Refractive indexes: In the case of Comparative Example 2, having a refractive index smaller than the range defined in the present invention, the print followed (copied) the flaw formed by a load lighter than that for Example 14, which fell in the range of the present invention.

Viscosities: In the case of Comparative Example 1, having a viscosity larger than the range defined in the present invention, the print copied the flaw formed by a load lighter than that for Example 5, which fell in the range of the present invention.

Boiling points: As is shown in Examples 13 and 14 of the present invention, when the boiling point is 100° C. or over, it is preferable in view of the printing, because bubbling due to volatilization of the solvent caused by the heat of the printer occurs less.

Contact angles: As is shown in This Inventions 11 and 12, when the contact angle is 30 degrees or less, it is preferable, because a flaw formed under a heavier load can be mended.

Wiping solvents: Wiping with a lower alcohol, such as IPA (isopropyl alcohol) and ethanol, is good, but wiping with an alcohol having 6 or more carbon atoms, as shown in Example 15, is not preferable, because the alcohol remains even after wiping.

High-molecular additives: As is shown in This Invention 7 and Comparative Example 2, the flaw-mending agents containing a material having a molecular weight of over 10,000 are not preferable, because they are apt to remain after wiping, and the wiped surface is likely to become milky-white.

Supports: Comparing the increase in load where a flaw appears in the case of the A-PEN (PEN support heat-treated at a temperature of Tg or below) support light-sensitive material with a flaw-mending agent, and the A-PEN (PEN support heat-treated at a temperature of Tg or below) support light-sensitive material without any flaw-mending agent (This Invention 1/Comparative Example 3), with the increase in load where a flaw appears in the case of PEN support light-sensitive materials (This Invention 2/Comparative Example 4), the effect of the flaw-mending agent (the difference of the loads) is more remarkable in the former light-sensitive materials.

Having described our invention as related to the present embodiments, it is our intention that the invention not be limited by any of the details of the description, unless otherwise specified, but rather be construed broadly within its spirit and scope as set out in the accompanying claims.

What I claim is:

1. A method for mending flaws on photographs, comprising the steps of:

applying a flaw-mending agent for silver halide photographic light-sensitive materials on a back surface of a negative film or a positive film after being subjected to development treatment, wherein the flaw-mending agent comprises a liquid having a refractive index in the range of 1.5 to 1.8, and a viscosity in the range of 0.1 cP to 100 cP, printing the negative film or the positive film by a printer, and wiping away the flaw-mending agent.

2. The method for mending flaws on photographs as claimed in claim 1, wherein a support of the photographic light-sensitive material comprises a polyester film.

3. The method for mending flaws on photographs as claimed in claim 2, wherein the polyester film is a polyethylene terephthalate-series film or a polyethylene naphthalate-series film.

4. The method for mending flaws on photographs as claimed in claim 2, wherein the polyester film is heat-treated at a temperature in the range of 40° C. to the glass transition temperature of the polyester.

5. The method for mending flaws on photographs as claimed in claim 1, wherein the wiping away is carried out with a lower alcohol solvent.

6. The method for mending flaws on photographs as claimed in claim 1, wherein the liquid that comprises the flaw-mending agent has a boiling point in the range of 100° C. to 500° C.

7. The method for mending flaws on photographs as claimed in claim 1, wherein a molecular weight of any of materials contained in the flaw-mending agent is in the range of 18 to 10,000.

8. The method for mending flaws on photographs as claimed in claim 1, wherein a contact angle of the flaw-mending agent with a polyethylene terephtalate-series film or a polyethylene naphthalate-series film is in the range of 1 degree to 30 degrees.

9. The method for mending flaws on photographs as claimed in claim 1, wherein a contact angle of the flaw-mending agent with a cellulose acetate-series film is in the range of 1 degree to 30 degrees.

* * * * *